US012751552B2

(12) United States Patent
Zhang

(10) Patent No.: US 12,751,552 B2
(45) Date of Patent: Oct. 6, 2026

(54) U-SHAPED PLATE FOR CUSHION AND SEAT FRAME

(71) Applicant: Nanjing Huandatong Electronic Technology Co., Ltd, Nanjing (CN)

(72) Inventor: Bingbing Zhang, Shouguang (CN)

(73) Assignee: Nanjing Huandatong Electronic Technology Co., Ltd, Nanjing (CN)

( * ) Notice: Subject to any disclaimer, the term of this patent is extended or adjusted under 35 U.S.C. 154(b) by 14 days.

(21) Appl. No.: 18/651,576

(22) Filed: Apr. 30, 2024

(65) Prior Publication Data

US 2025/0331646 A1 Oct. 30, 2025

(51) Int. Cl.

| | |
|---|---|
| ***A47C 7/62*** | (2006.01) |
| ***A47B 23/02*** | (2006.01) |
| ***A47B 85/04*** | (2006.01) |
| ***A47C 7/02*** | (2006.01) |

(52) U.S. Cl.

CPC ..... *A47C 7/62* (2013.01); *A47B 23/02* (2013.01); *A47B 85/04* (2013.01); *A47C 7/0213* (2018.08)

(58) Field of Classification Search

CPC ..... A47C 7/622; A47C 7/68; A47C 7/624; A47B 3/063; A47B 83/02; A47B 45/00; A47B 3/12

See application file for complete search history.

(56) References Cited

U.S. PATENT DOCUMENTS

| | | | | | |
|---|---|---|---|---|---|
| 2,679,283 | A * | 5/1954 | Mahone | A61G 5/1059 | 5/81.1 R |
| 5,140,914 | A * | 8/1992 | Bohbot | A47C 7/70 | 108/44 |
| 6,113,182 | A * | 9/2000 | Wise | A47B 85/06 | 297/119 |
| D438,402 | S * | 3/2001 | Walsh | D6/675 | |
| 6,209,154 | B1 * | 4/2001 | Huang | A47C 17/162 | 297/354.13 |
| 7,017,215 | B1 * | 3/2006 | Singer | A61G 13/12 | 5/646 |
| D765,450 | S * | 9/2016 | Biddle | D6/691 | |
| D1,046,487 | S * | 10/2024 | Yu | D6/672 | |
| 2002/0021034 | A1 * | 2/2002 | Morgan | A47C 1/143 | 297/228.12 |

(Continued)

FOREIGN PATENT DOCUMENTS

| | | | | |
|---|---|---|---|---|
| CN | 107951256 A * | 4/2018 | A47B 83/02 | |
| CN | 209096880 U | 7/2019 | | |

(Continued)

*Primary Examiner* — Arfan Y. Sinaki
(74) *Attorney, Agent, or Firm* — George D. Morgan

(57) ABSTRACT

A furniture system comprising a U-shaped plate (1) placed upside down and clamping a cushion (2), and the cushion (2) arranged on a seat frame (3), the U-shaped plate (1) is integrally formed, both ends of the U-shaped plate (1) are bent 90 degrees, corners at both ends of the U-shaped plate (1) are arc-shaped, the U-shaped plate is adapted to the cushion and is placed on the upper surface of the cushion. Both sides of the U-shaped plate are adjacent to the side surfaces of the cushion. The U-shaped plate (1) placed on the cushion (2) increases the hardness of the cushion. The cushion with the U-shaped plate (1) on top is used as a tea table or a coffee table. Coffee, cups, fruit trays, is placed on the U-shaped plate (1).

8 Claims, 13 Drawing Sheets

(56) References Cited

U.S. PATENT DOCUMENTS

| | | | | |
|---|---|---|---|---|
| 2004/0026972 | A1* | 2/2004 | Spendlove | A47C 7/445<br>297/301.1 |
| 2005/0140184 | A1* | 6/2005 | Williams | A47C 13/00<br>297/135 |
| 2015/0265059 | A1* | 9/2015 | Qiao | A47C 7/624<br>108/42 |
| 2020/0093266 | A1* | 3/2020 | Tristan | A47B 3/06 |
| 2024/0057758 | A1* | 2/2024 | Sun | A47B 83/021 |

FOREIGN PATENT DOCUMENTS

| | | | |
|---|---|---|---|
| CN | 213799989 | U | 7/2021 |
| CN | 216943372 | U | 7/2022 |

* cited by examiner

U-SHAPED PLATE FOR CUSHION AND SEAT FRAME

TECHNICAL FIELD

The disclosure relates to the technical field of furniture design and manufacturing, and in particular, relates to a U-shaped plate for a cushion.

BACKGROUND

Sofa is one of the indispensable furniture in outdoor courtyards and indoor living rooms. A sofa set contains a cushion which is soft and comfortable but not suitable for placing items. Due to the softness and low hardness of the cushion, items such as cups and fruit trays will be unstable when placed on the cushion and may easily fall off the cushion. For a cushion, users have the need to place items, but there is no suitable location for placing items.

Therefore, the applicant provides a U-shaped plate for a cushion to solve the problem raised in the above background art.

SUMMARY

It is an object of the disclosure to provide a U-shaped plate for a cushion, which solves the problems that existing cushions are soft and low in hardness, and items cannot be placed on a cushion.

In order to solve the above technical problem, the disclosure provides a U-shaped plate for a cushion. The U-shaped plate for a cushion includes a U-shaped plate which is placed upside down and clamps a cushion, and the cushion arranged on a seat frame. The U-shaped plate is integrally formed, both ends of the U-shaped plate are bent 90 degrees, corners at both ends of the U-shaped plate are arc-shaped, a plurality of fixing belts are provided on a lower surface of the cushion, hook-and-loop fasteners are provided on both sides of the fixed straps, and two hook-and-loop fasteners are corresponding attached.

Further, the length of the U-shaped plate is adapted to the length of a cushion.

Further, the seat frame includes seat leg frames symmetrically provided on both sides of a seat plate, and an upper surface of the seat plate and upper surfaces of the seat leg frames are in a common plane.

Further, a cross beam is provided within a body of the seat plate, and both end surfaces of the cross beam are fixed to an inner side wall of the body of the seat plate.

Further, a plurality of vertical plates are installed on an upper surface of the cross beam, and both end surfaces of the vertical plates are fixed to the inner side wall of the body of the seat plate.

Further, the seat leg frame is an n-shaped frame, and connecting rods are provided horizontally at middle parts of the two seat leg frames.

Further, two ends of a crossbar are respectively fixed to middle sections of the two connecting rods.

Further, the U-shaped plate is made from a material selected from metal, acrylic, plastic, etc.

By adopting the above technical solution, the disclosure has the following beneficial effects:

1. The disclosure provides a U-shaped plate for a cushion. The U-shaped plate is adapted to the cushion and can be placed on the upper surface of the cushion. Both sides of the U-shaped plate are adjacent to the side surfaces of the cushion. The U-shaped plate placed on the cushion increases the hardness of the cushion. The cushion with the U-shaped plate on top can be used as a tea table or a coffee table. Coffee, cups, fruit trays, etc., can be placed on the U-shaped plate.
2. When the cushion is not used as a tea table or a coffee table, the U-shaped plate can be stored between the seat frame and the cushion, which is convenient for next use.

BRIEF DESCRIPTION OF DRAWINGS

In order to more clearly illustrate the embodiments of the disclosure or the technical solutions in the prior art, the drawings used in the description of the embodiments or the prior art will be briefly described below. It is obvious that the drawings in the following description are only some embodiments of the invention, and that those skilled in the art can obtain other drawings according to these drawings without involving any inventive effort.

Figure 1:
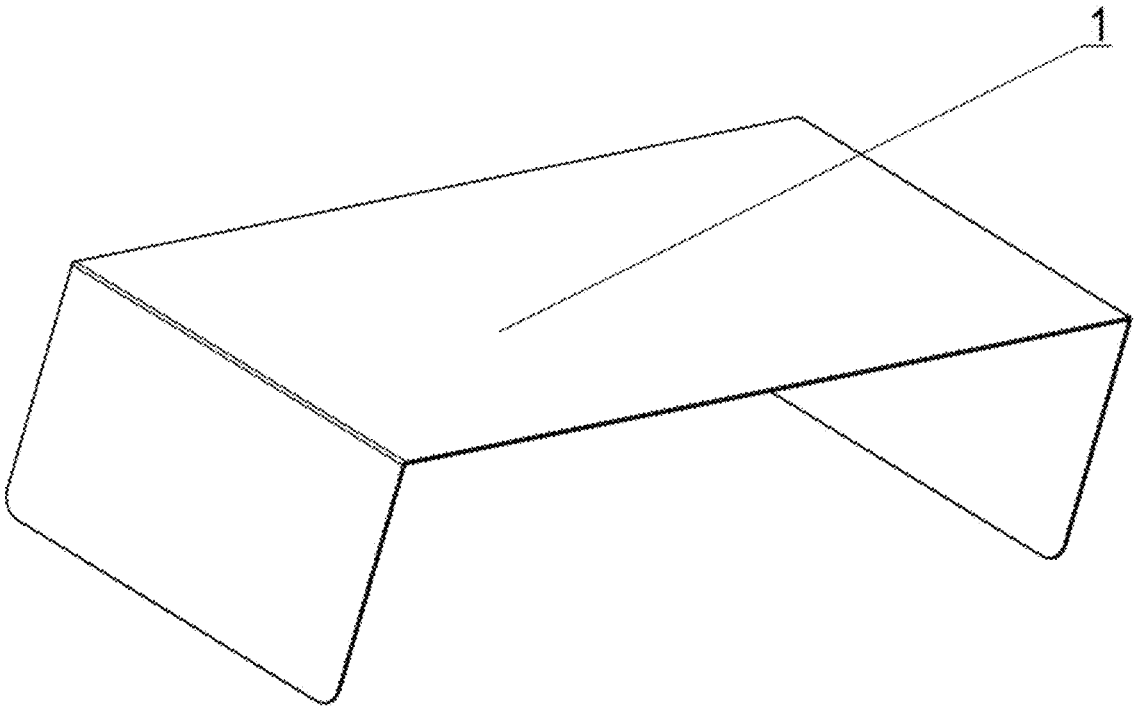
FIG. 1 is an overall schematic diagram of a U-shaped plate for a cushion.

Reference numerals: 1. U-shaped plate; 2. cushion; 21. fixing belt; 211. hook-and-loop fastener; 3. seat frame; 31. crossbar; 32. seat plate; 321. cross beam; 322. vertical plate; 33. seat leg frame; 331, connecting rod.

DETAILED DESCRIPTION OF THE EMBODIMENTS

The technical schemes of the disclosure will be clearly and completely described below in conjunction with the accompanying drawings, and obviously, the described embodiments are merely some, but not all embodiments of the disclosure. Based on the embodiments of the disclosure, all other embodiments obtained by those skilled in the art without involving any inventive effort are within the scope of the disclosure.

In the description of the disclosure, it should be noted that the terms such as "central", "upper", "lower", "left", "right", "vertical", "horizontal", "inner", "outer", and the like indicate orientations or positional relationships based on the orientations or positional relationships shown in the drawings, and are merely for the convenience of describing the disclosure to simplify the description, and do not indicate or imply that the referred device or element must have a particular orientation or be constructed and operated in a particular orientation, and thus should not be construed as limitations of the disclosure. Further, the terms "first", "second" and "third" are used for descriptive purposes only and are not to be construed as indicating or implying relative importance.

In the description of the disclosure, it should be noted that unless otherwise clearly stated and limited, the terms "installation" and "connection" should be interpreted in a broad sense. For example, it may be a fixed connection or a detachable connection or an integral connection; it may be a mechanical connection or an electrical connection; it may be a direct connection or an indirect connection through an intermediate medium; it may be an internal connection between two components. For those of ordinary skill in the art, the specific meanings of the above terms in the disclosure can be understood on a case-by-case basis.

The disclosure will be further explained below in conjunction with specific embodiments.

Figure 2:
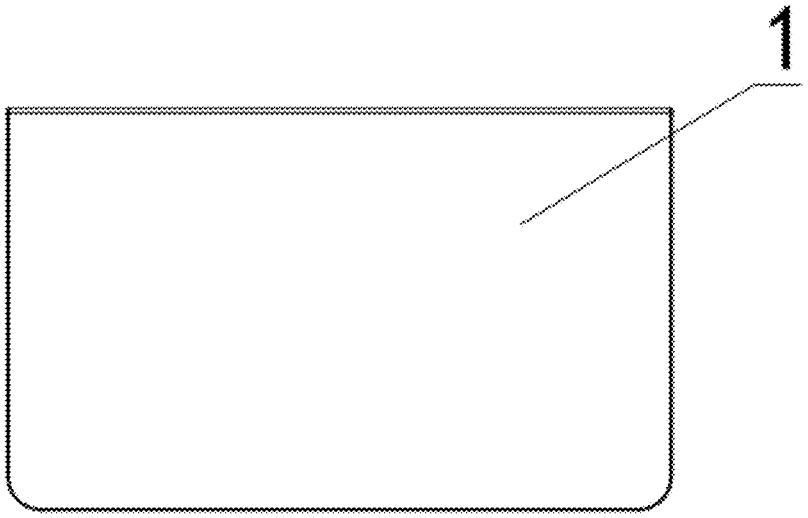
FIG. 2 is a side view of a U-shaped plate.
Figure 3:
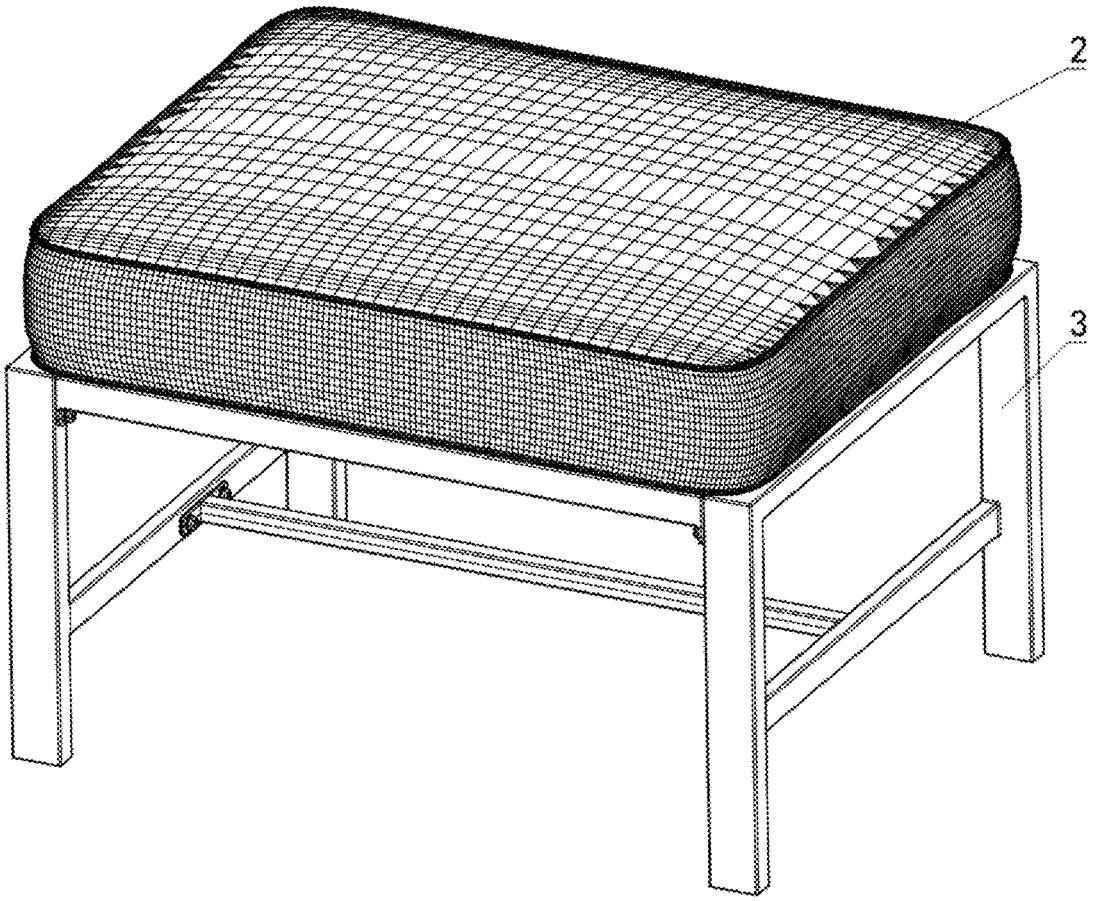
FIG. 3 is an overall schematic diagram of a combination of a cushion and a seat frame according to an embodiment.
Figure 4:
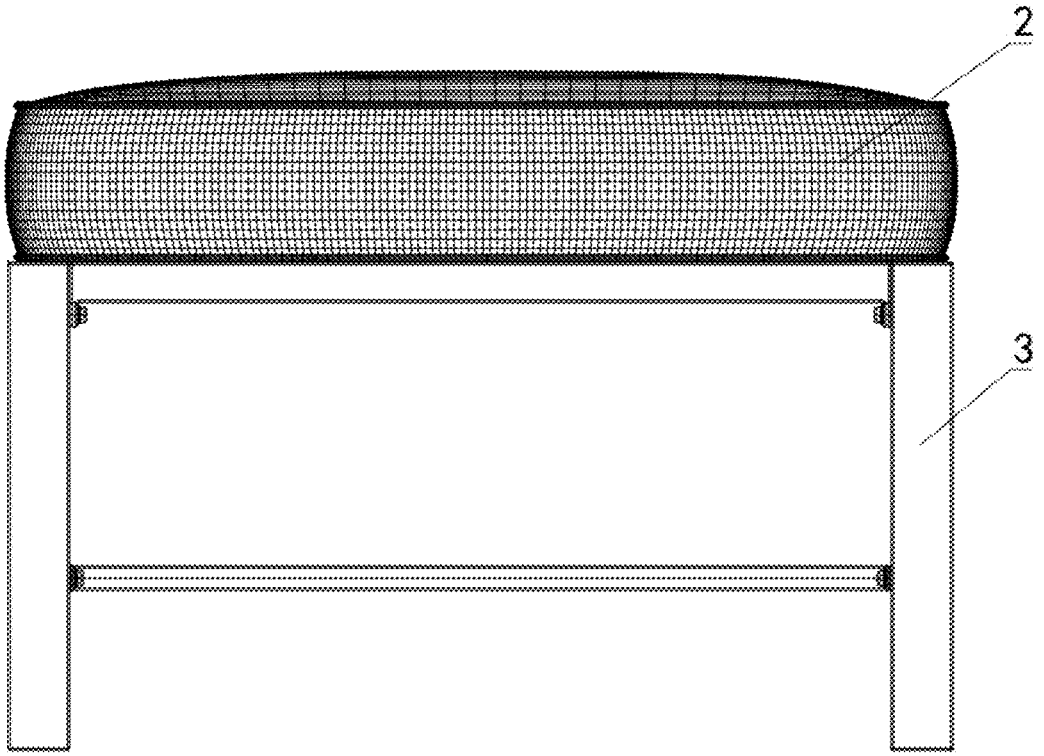
FIG. 4 is a front view of a combination of a cushion and a seat frame according to an embodiment.
Figure 5:
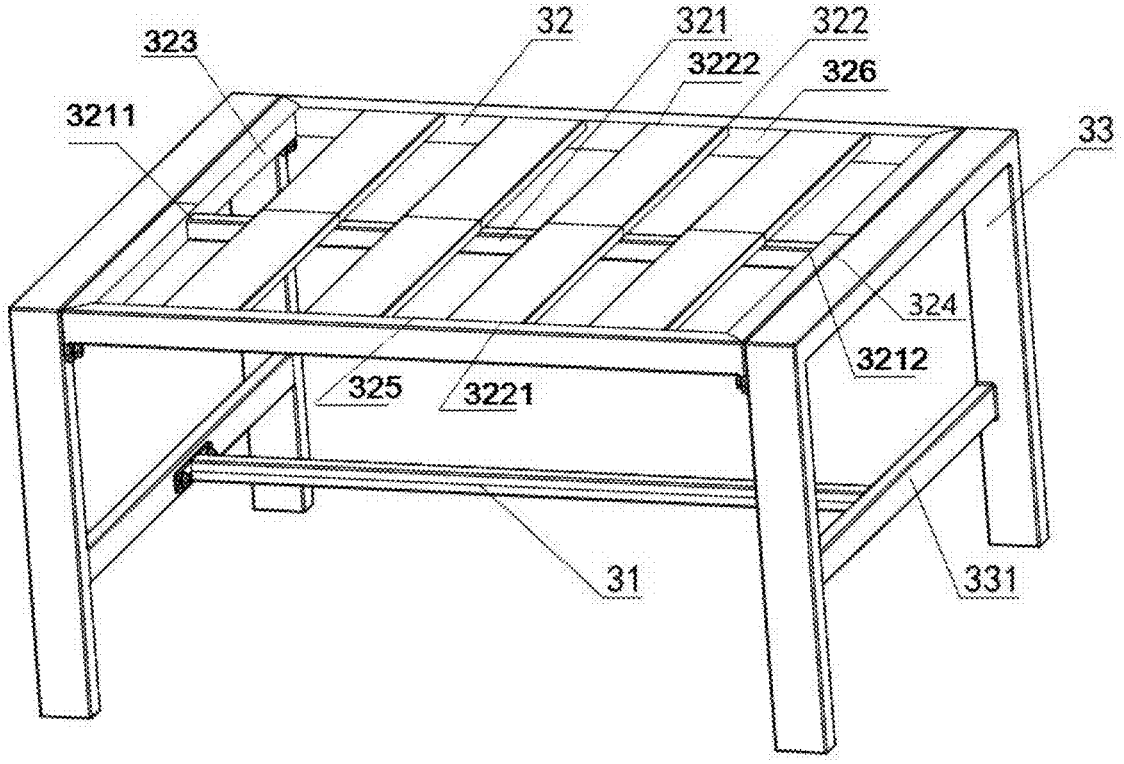
FIG. 5 is an overall schematic diagram of the seat frame in FIG. 3.
Figure 6:
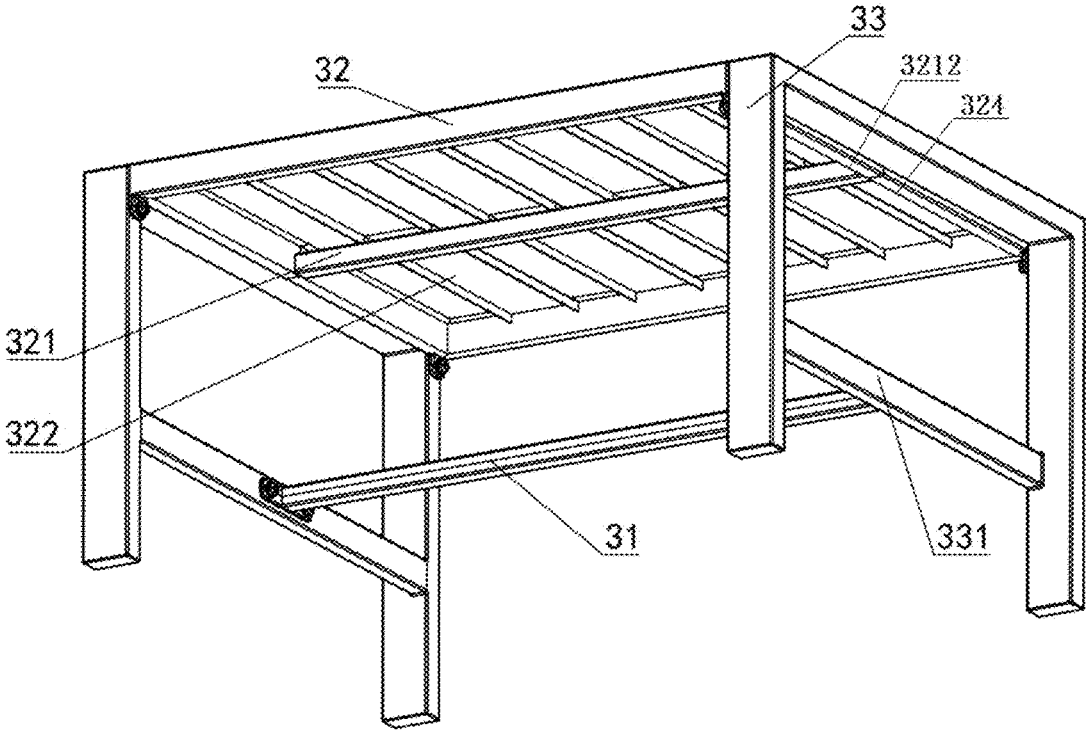
FIG. 6 is a schematic diagram of the bottom structure of the seat frame in FIG. 4.
Figure 7:
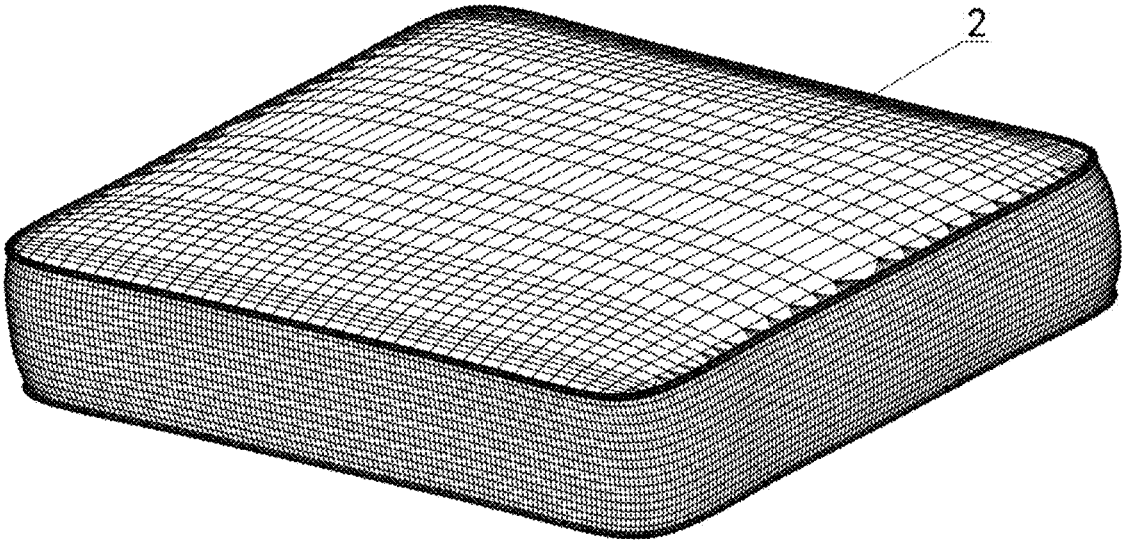
FIG. 7 is an overall schematic diagram of the cushion in FIG. 4.
Figure 8:
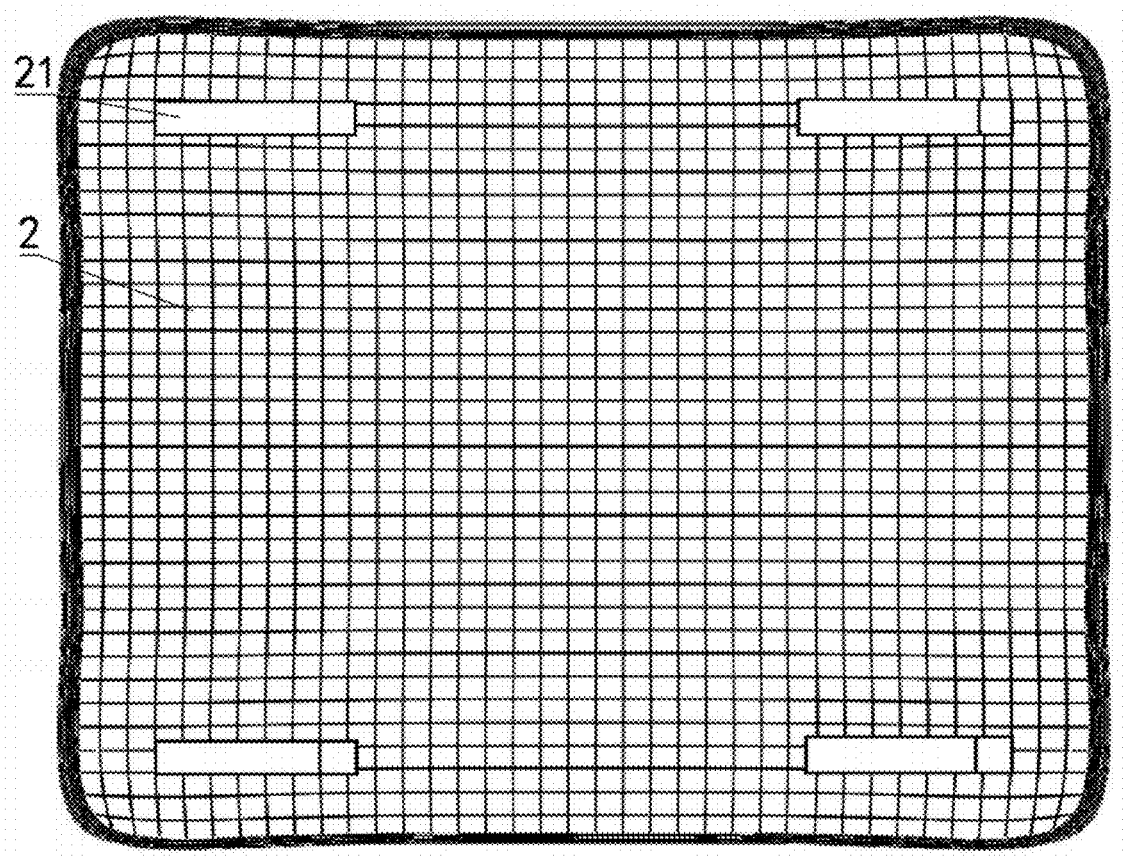
FIG. 8 is a schematic diagram of the bottom structure of the cushion in FIG. 4.
Figure 9:
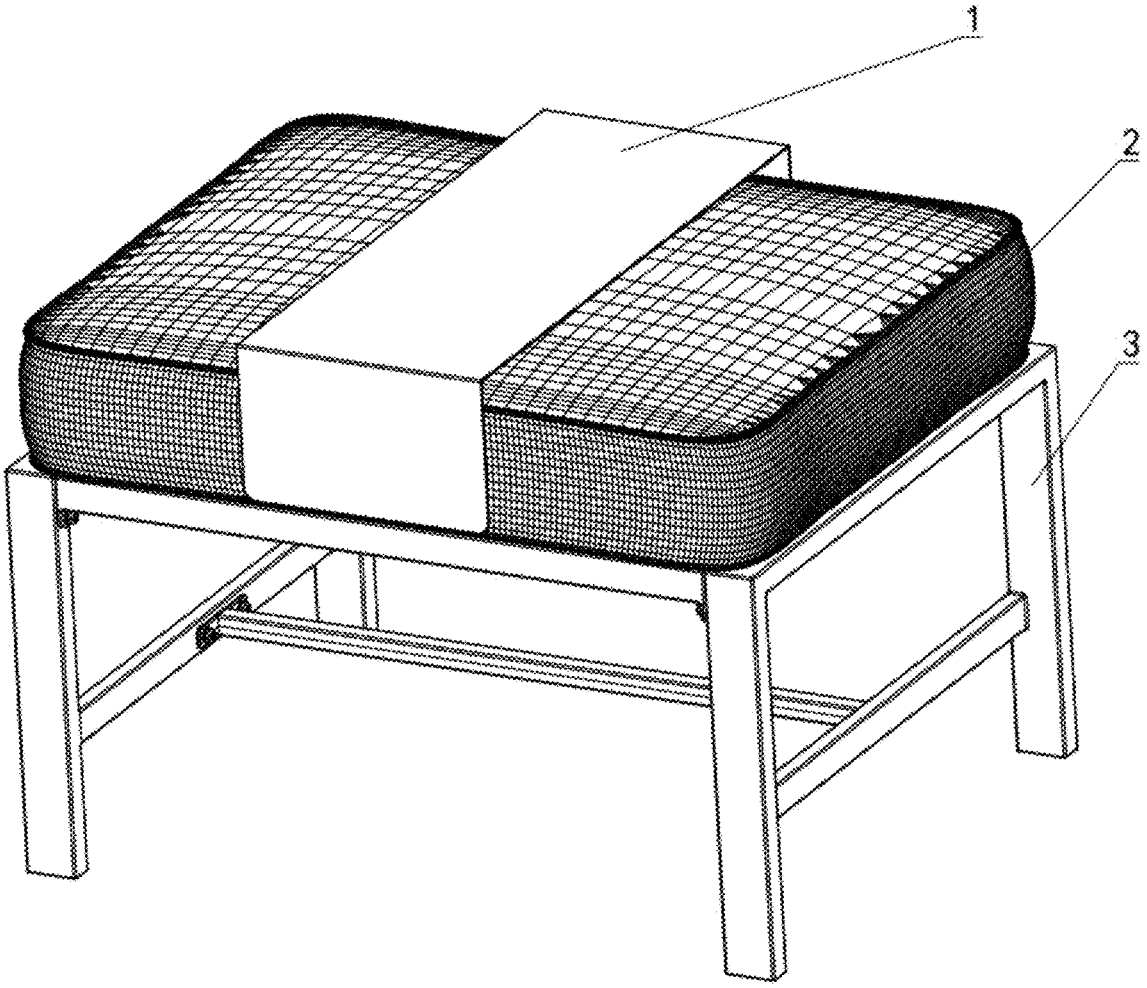
FIG. 9 is an overall schematic diagram of a cushion with a U-shaped plate according to an embodiment.
Figure 10:
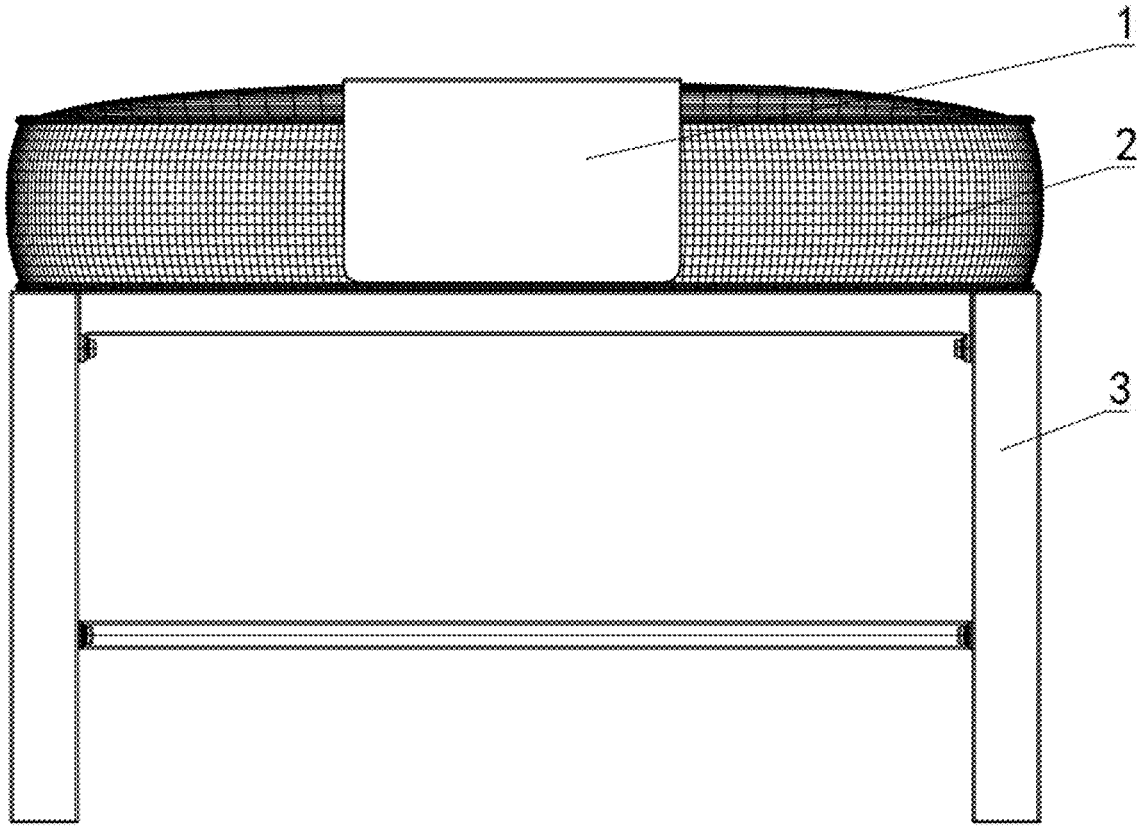
FIG. 10 is a front view of a cushion with a U-shaped plate according to an embodiment.
Figure 11:
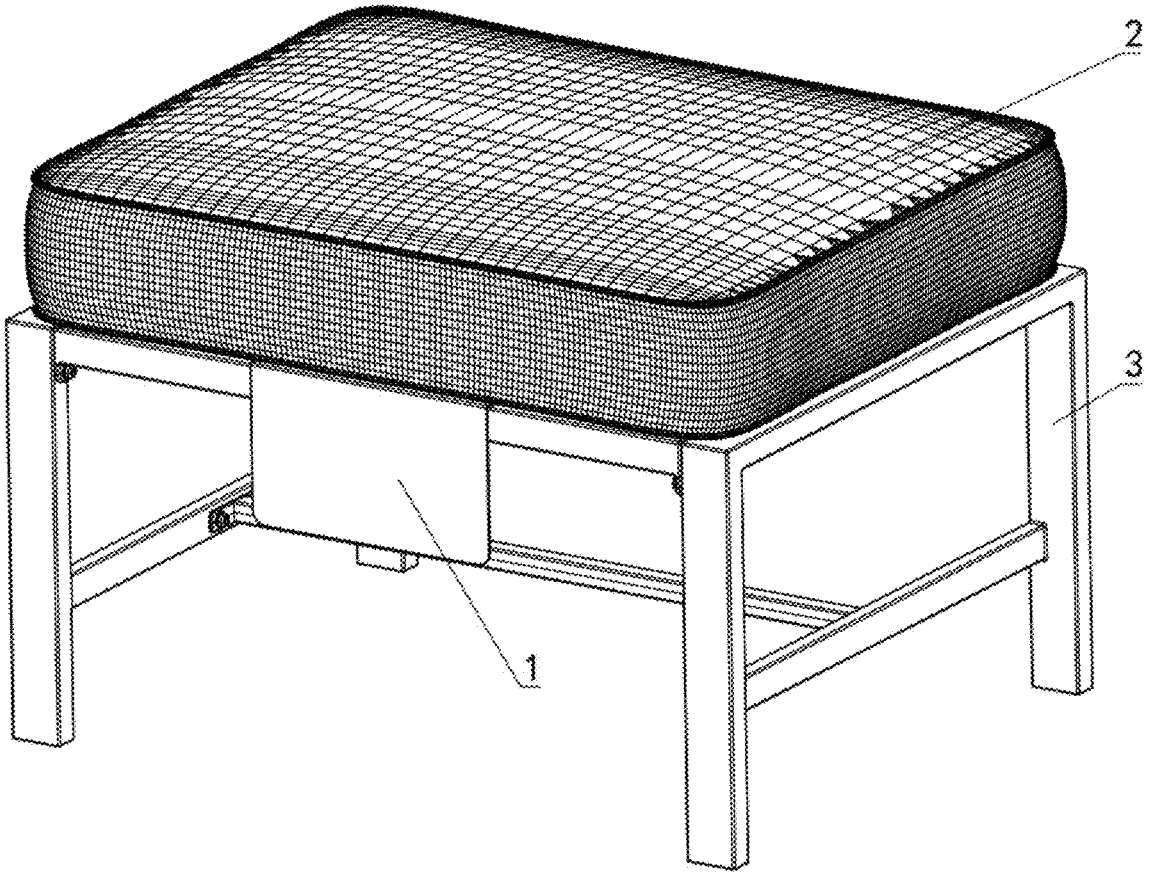
FIG. 11 is an overall schematic diagram of a U-shaped plate being stored according to an embodiment.
Figure 12:
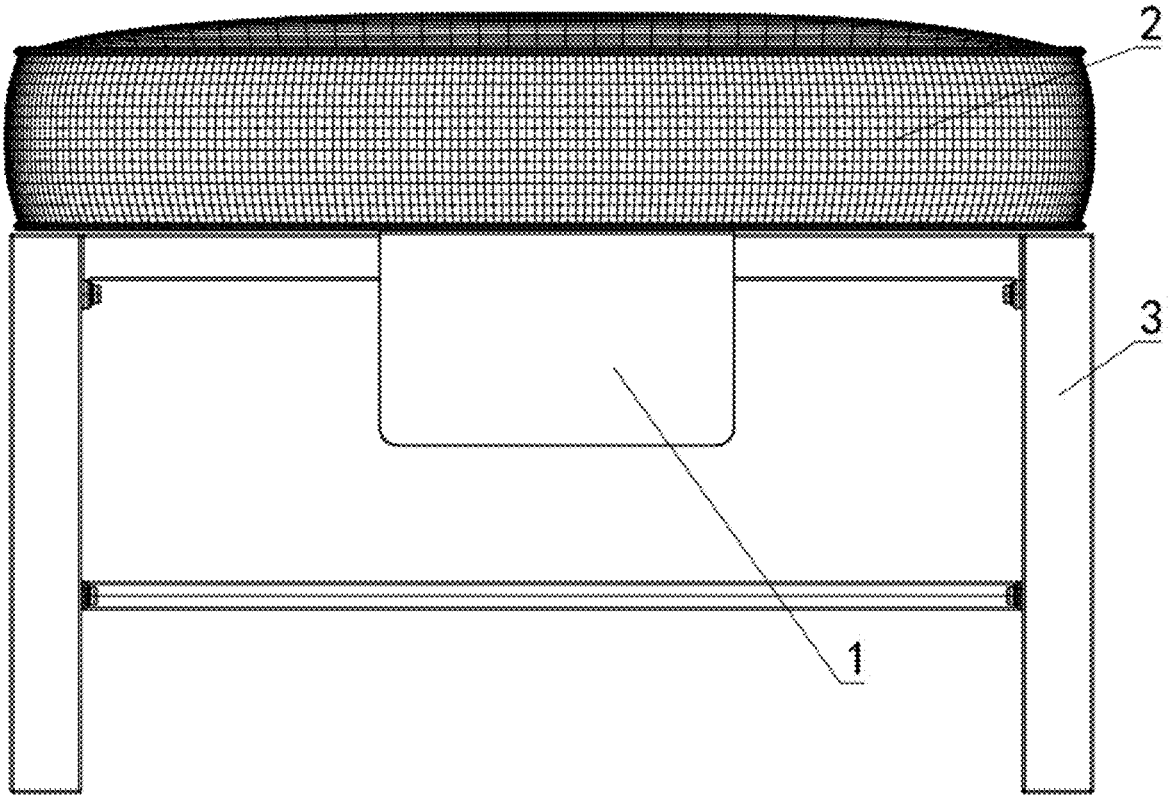
FIG. 12 is a front view of a U-shaped plate being stored according to an embodiment.
Figure 13:
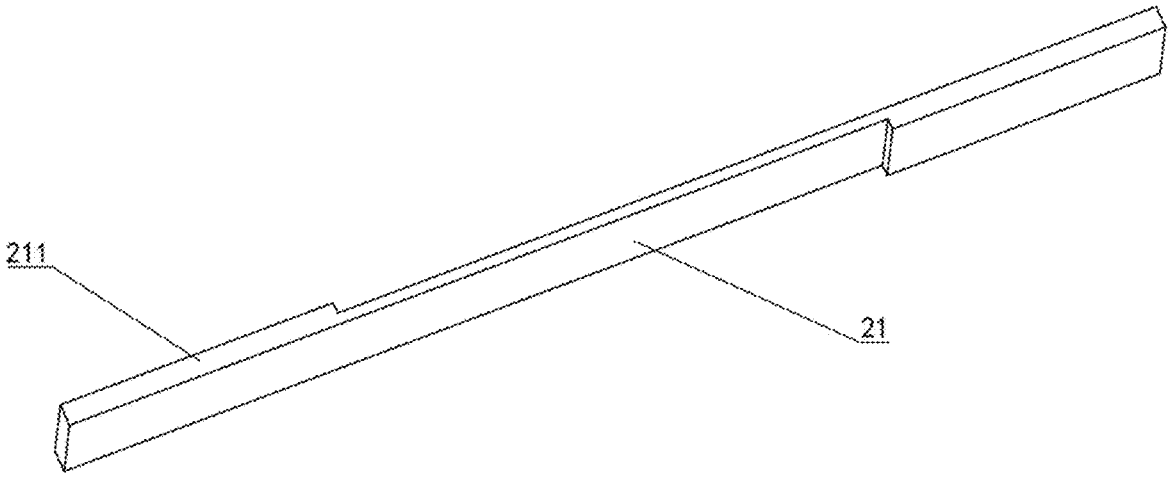
FIG. 13 is an overall schematic diagram of a fixing belt in FIG. 8.

As shown in FIGS. 1-13, this embodiment provides a U-shaped plate for a cushion, including a U-shaped plate 1 which is placed upside down and clamps a cushion 2, and the length of the U-shaped plate 1 is adapted to the length of the cushion 2. The U-shaped plate can be placed on the cushion, and both sides of the U-shaped plate are adjacent to the side walls of the cushion. Under the action of gravity, an inner upper surface of the U-shaped plate completely fits an upper surface of the cushion. The cushion with the U-shaped plate on top can be used as a tea table or a coffee table. Coffee, cups, fruit trays, etc., can be placed on the U-shaped plate. When the cushion is not needed for use as a tea table or a coffee table, the U-shaped plate can be stored between the seat frame and the cushion, which is convenient for next use. The U-shaped plate 1 is integrally formed, both ends of the U-shaped plate are bent 90 degrees, and corners at both ends of the U-shaped plate are arc-shaped. The U-shaped plate has a certain degree of hardness and support force, and may be made of a material selected from metal, acrylic, plastic, etc. The arc-shaped corners of the U-shaped plate may replace sharp right angles to be more beautiful and comfortable and reduce home safety hazards. The length of the U-shaped plate is adapted to the size of the seat frame, making it easy for the U-shaped plate to be stored between the cushion and the seat frame.

In this embodiment, a plurality of fixing belts 21 are provided on a lower surface of the cushion 2, hook-and-loop fasteners 211 are respectively provided on both sides of the fixing belt 21, and two hook-and-loop fasteners 211 are correspondingly attached. A middle part of the fixing belt is fixed on the lower surface of the cushion, and both ends of the fixing belt are movable. The two hook-and-loop fasteners are respectively provided on the front and back sides of the fixing belt. When in use, the two ends of the fixing belt are wrapped around the vertical plate, and the two hook-and-loop fasteners are attached to fix the cushion on the seat plate and prevent the cushion from shifting and sliding off the seat frame.

In this embodiment, the seat frame 3 includes seat leg frames 33 provided symmetrically on both sides of the seat plate 32, and an upper surface of the seat plate 32 and upper surfaces of the seat leg frame 33 are in a common plane. Two side surfaces of the seat plate are connected to the two seat leg frames through bolts. The upper surface of the seat plate and the upper surfaces of the seat leg frames together form the upper surface of the seat frame, on which the cushion is placed.

In this embodiment, a cross beam 321 is provided within a body of the seat plate 32, and both end surface 3211 and end surface 3212 of the cross beam 321 are fixed to an inner side wall 323 and another inner side wall 324 of the body of the seat plate 32. A plurality of vertical plates 322 are installed on an upper surface of the cross beam 321, and both end surface 3221 and end surface 3222of the vertical plates 322 are fixed to an inner side wall 325 and another inner side wall 326 of the body of the seat plate 32. The cross beam is provided at a central position inside the seat plate. The cross beam is perpendicular to the vertical plates. The plurality of vertical plates form a contact surface between the seat plate and the cushion. The cross beam serves to support the upper vertical plate, ensuring the stability and safety of the seat plate, and preventing the vertical plate from bending and deforming under pressure.

In this embodiment, the seat leg frame 33 is an n-shaped frame, and connecting rods 331 are provided horizontally at middle parts of the seat leg frame 33. The connecting rod is connected to the middle parts of two seat legs in the seat leg frame and is used to reinforce the seat leg frame. Two ends of a crossbar 31 are respectively fixed to middle sections of the two connecting rods 331. The two seat leg frames are connected and reinforced by the crossbar. Both ends of the crossbar are connected to the middle sections of the connecting rods on the two seat leg frames through bolts. The crossbar plays a supporting role and strengthen the connection between the two seat leg frames. It prevents the seat frame from disintegrating and falling apart, and improves the stability and safety of the seat frame.

Finally, it should be noted that the above embodiments are only for explaining the technical solutions of the disclosure, and are not intended to be limitations thereof. Although the disclosure has been described in detail with reference to the foregoing embodiments, those skilled in the art will understand that the technical solutions described in the foregoing embodiments may be modified, or some or all of the technical features may be replaced by equivalents; and the modifications or substitutions do not deviate from the scope of the technical solutions of the embodiments of the disclosure.

What is claimed is:

1. A furniture system, comprising: a U-shaped plate (1) placed upside down and clamping a cushion (2), and the cushion (2) arranged on a seat frame (3), wherein the U-shaped plate (1) is integrally formed, both ends of the U-shaped plate (1) are bent 90 degrees, corners at both ends of the U-shaped plate (1) are arc-shaped, a plurality of fixing belts (21) are provided on a lower surface of the cushion, hook-and-loop fasteners (211) are provided on both sides of the fixing belt (21), and two hook-and-loop fasteners (211) are correspondingly attached, the U-shaped plate (1) is placed on the cushion (2), and both sides of the U-shaped plate (1) are adjacent to side walls of the cushion (2), under the action of gravity, the cushion (2) with the U-shaped plate (1) on top is used as a tea table or a coffee table, when the cushion (2) is not needed for use as the tea table or the coffee table, the U-shaped plate (1) is configured to be stored between the seat frame (3) and the cushion (2), when the cushion (2) is not needed for use as the tea table or the coffee table, the U-shaped plate (1) is configured to arrange on the seat frame (3), both sides of the U-shaped plate (1) are adjacent to side walls of the seat frame (3), a length of the U-shaped plate (1) is greater than a width of the same frame (3).

2. The furniture system according to claim 1, wherein the length of the U-shaped plate (1) is greater than a length of the cushion (2).

3. The furniture system according to claim 1, wherein the seat frame (3) comprises seat leg frames (33) symmetrically provided on both sides of a seat plate frame (32), and an upper surface of the seat plate frame (32) and upper surfaces of the seat leg frames (33) are in a common plane.

4. The furniture system according to claim 3, wherein a cross beam (321) is provided within a body of the seat plate frame (32), and both end surfaces of the cross beam (321) are fixed to two inner side walls of the body of the seat plate frame (32).

5. The furniture system according to claim 4, wherein a plurality of vertical plates (322) are installed on an upper surface of the cross beam (321), and both end surfaces of the vertical plates (322) are fixed on two inner side walls of the body of the seat plate frame (32).

6. The furniture system according to claim 3, wherein the seat leg frame (33) is an n-shaped frame, and connecting rods (331) are provided horizontally at middle parts of the two seat leg frames (33).

7. The furniture system according to claim 6, wherein two ends of a crossbar (31) are respectively fixed to middle sections of the two connecting rods (331).

8. The furniture system according to claim 1, wherein the U-shaped plate (1) is made from a material selected from metal, acrylic, and plastic.

* * * * *